United States Patent [19]

Engel et al.

[11] 4,147,092

[45] Apr. 3, 1979

[54] SELF-FILLING FLUID DEVICE

[75] Inventors: William K. Engel, Peoria; Robert C. Hansen, East Peoria, both of Ill.

[73] Assignee: Caterpillar Tractor Co., Peoria, Ill.

[21] Appl. No.: 773,045

[22] Filed: Feb. 28, 1977

[51] Int. Cl.[2] ..... F01B 13/04

[52] U.S. Cl. ..... 91/490

[58] Field of Search ..... 91/6.5, 472, 473, 490, 91/491, 492, 493, 494, 495, 496, 497, 498; 417/273; 418/270

[56] References Cited

U.S. PATENT DOCUMENTS

| | | | |
|---|---|---|---|
| 1,360,128 | 11/1920 | MacTaggart et al. | 91/6.5 |
| 2,453,266 | 11/1948 | Rockwell | 417/270 X |
| 2,566,418 | 9/1951 | Horton | 91/473 |
| 3,165,029 | 1/1965 | Haldimann | 91/498 X |
| 3,799,034 | 3/1974 | Haglund et al. | 91/490 |
| 3,899,957 | 8/1975 | Carlson, Jr. et al. | 91/490 |
| 3,924,515 | 12/1975 | Clerk | 91/472 |

*Primary Examiner*—Carlton R. Croyle
*Assistant Examiner*—Leonard E. Smith
*Attorney, Agent, or Firm*—John L. James

[57] ABSTRACT

A fluid device has an inlet and a pumping chamber which is positioned in spaced relation to the inlet. The chamber is rotatably movable relative to the inlet. Apparatus is provided for contacting the fluid at the inlet at a preselected angle sufficient for accelerating the fluid into the chamber.

11 Claims, 4 Drawing Figures

SELF-FILLING FLUID DEVICE

BACKGROUND OF THE INVENTION

Fluid devices such as pumps and motors are used on work vehicles. The smallest possible pump is often used because of space and cost limitations. The pump is operated near its limiting speed to produce the required amount of fluid flow and frequently the limiting speed is such that the pump cannot completely fill its inlet side and pumping chamber with fluid. When used in the implement system of a work vehicle, the pump is expected to completely fill its inlet side and pumping chamber with fluid at the rated speed without any significant pressure other than atmospheric pressure pushing the fluid into the inlet and pumping chamber. Incomplete filling results in reduced pump efficiency, noisy pump operation, and possible damage to the pump.

The present invention is directed to overcoming one or more of the problems as set forth above.

According to the present invention, a fluid device has an inlet and a pumping chamber which is positioned in spaced relation to the inlet. The chamber is rotatably movable relative to the inlet in a preselected direction at a preselected speed. Apparatus is provided for contacting the fluid at a preselected angle sufficient for moving the fluid from the inlet and accelerating the fluid into the pumping chamber.

DETAILED DESCRIPTION OF THE INVENTION

Figure 1:
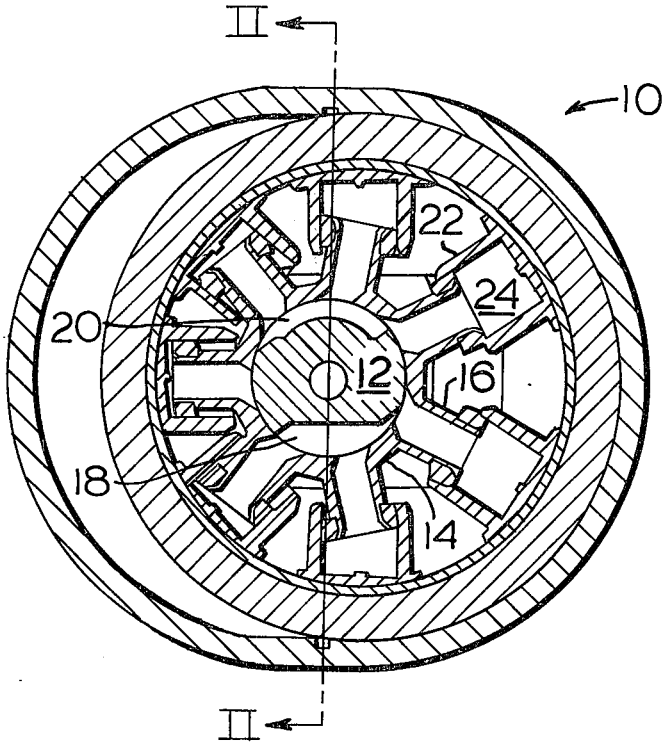
FIG. 1 is a sectional view taken through a fluid device along the line I—I of FIG. 2.
Figure 2:
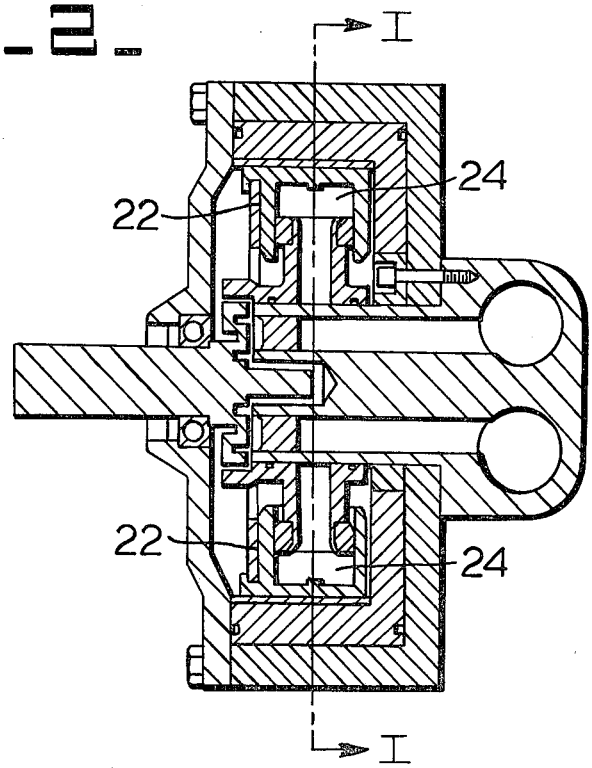
FIG. 2 is a sectional view taken through the fluid device along the line II—II of FIG. 1.

Referring to FIG. 1, a fluid device, such as a pump 10, for example, has a stationary pintle 12 and a rotor 14 which is positioned in a spaced relationship about the pintle 12. The rotor 14 has a plurality of hollow spokes 16 and the pintle 12 has inlet and outlet passages 18, 20. The rotor 14 rotates about the pintle 12 in a preselected direction, counterclockwise for instance, at a preselected speed, thus, the spokes 16 rotate relative the inlet and outlet 18, 20. Each spoke 16 is slidably connected to a cap-like cylinder 22 having a pumping chamber 24.

Figure 3:
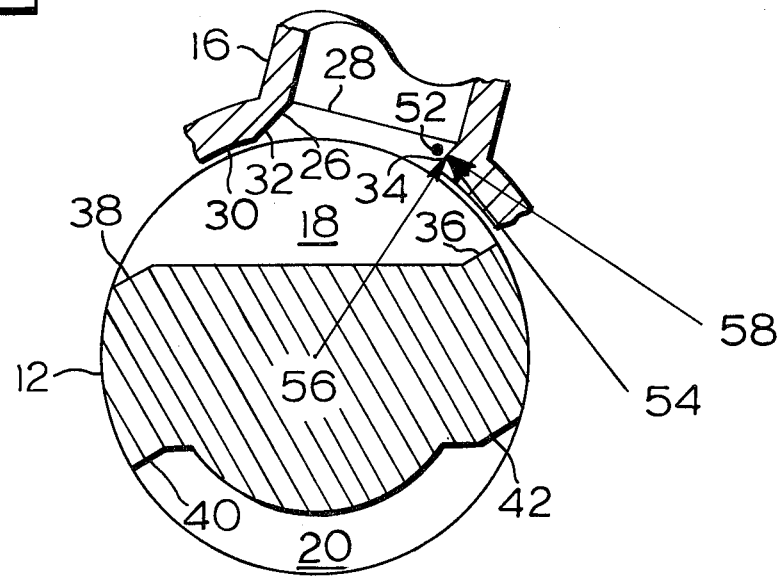
FIG. 3 is a somewhat enlarged partial view similar to FIG. 1.

Referring to FIG. 3, each spoke 16 has an angled entrance 26 which has top portion 28 which is positioned inside the spoke 16 and pumping chamber 24 and a bottom portion 30. The angled entrance 26 is preferably oriented for extending from the top portion 28 in the direction of rotation of the spoke 16. The entrance 26 also has leading and lagging portions 32, 34 which also are angled to substantially the same degree in substantially the same direction. The inlet 18 has leading and lagging edge portions 36, 38 which are individually alignable in a common plane with the leading edge portion 32 of the angled entrance. The outlet 20 has leading and lagging edge portions 40, 42 which are substantially similar to the respective lagging and leading edges 36, 38 of the inlet 18.

Figure 4:
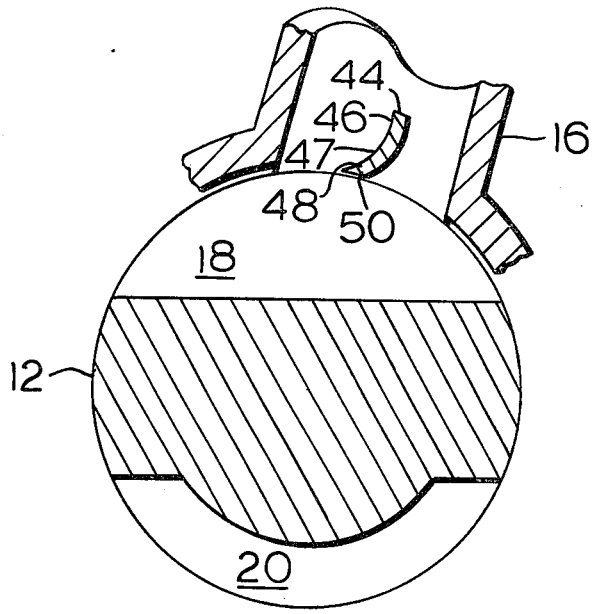
FIG. 4 is a partial view similar to FIG. 3, but showing another embodiment of the present invention.

Referring to FIG. 4, each spoke 16 has a number of vanes 44 positioned therein in spaced relation to the inlet 18. The vane 44 is used alone or with the angled entrance 26 (FIG. 3). The vane 44 has a surface 46, which is preferably generally planar but which may have a generally concave configuration 47 with the concave portion 47 facing in the direction of rotation of the rotor 14. The vane 44 is oriented with a lower edge portion 48 preferably directed in the direction of rotation of the rotor 14 and a lower edge 50 preferably extending in a direction parallel to the axis of rotation of the rotor 14. The vane 44 and angled entrance 26 preferably are substantially the same angle when used together.

Operation of the present invention is illustrated in FIG. 3 in which a dot 52 representing a stationary or moving molecule or other similar unit of fluid has entered the angled entrance 26. The dot 52 is about to be struck by the lagging edge portion 34 of the angled entrance 26. The energy imparted to the dot 52 by the lagging edge 34 is substantially perpendicular to the lagging edge 34 as shown by a force vector 54. The force vector 54 has a generally radial component 56 and a generally rotational or tangential component 58. Because of the angle of the lagging edge portion 34 of the angled entrance 26, the radial component 56 is directed outwardly into the pumping chamber 24, thus aiding fill capability. The angled entrance 26, inlet 18 and outlet 20 cooperate and further aid fill capability by reducing sharp turns for the fluid. The vane 44 operates in a similar manner.

The pump 10 can be designed to operate in the reverse direction of rotation or can be designed to operate as a motor.

The embodiments of the invention in which an exclusive property or privilege is claimed are defined as follows:

1. In a fluid device having a first portion defining an inlet and a second portion defining at least one pumping chamber, said chamber being positioned in spaced relation to said inlet for receiving fluid therefrom and being rotatably movable relative to said inlet in a preselected direction at a preselected speed, the improvement comprising:

means, positioned in said pumping chamber adjacent the inlet at a preselected angle, for contacting fluid at the inlet and imparting energy thereto which is substantially perpendicular to the means and forcibly moving the fluid from the inlet and accelerating said fluid radially into said pumping chamber in response to rotation of said means with said chamber.

2. An apparatus, as set forth in claim 1, wherein the means comprises an angled entrance to said pumping chamber, said angled entrance having leading and lagging portions and top and bottom portions, said top portion being positioned within said chamber, said leading and lagging portions being angled to substantially the same degree in substantially the same direction and extending from the top portion toward the adjacent inlet.

3. An apparatus, as set forth in claim 2, wherein said angled entrance is oriented for extending from the top portion in the direction of rotation of said pumping chamber.

4. An apparatus, as set forth in claim 1, wherein the fluid device is a pump.

5. In a fluid device having a first portion defining an inlet and a second portion defining at least one pumping chamber, said chamber being positioned in spaced relation to said inlet for receiving fluid therefrom and being rotatably movable relative to said inlet in a preselected direction at a preselected speed, the improvement comprising:

means, positioned in said pumping chamber adjacent the inlet, for contacting fluid at the inlet at a preselected angle sufficient for forcibly moving the fluid from the inlet and accelerating said fluid into said pumping chamber in response to rotation of said means with said chamber, said means comprising an angled entrance to said pumping chamber, said angled entrance having leading and lagging portions and top and bottom portions, said top portion being positioned within said chamber, said leading and lagging portions being angled to substantially the same degree in substantially the same direction and extending from the top portion toward the adjacent inlet, said inlet having leading and lagging edges, said leading edge of the inlet and leading edge of said angled entrance being of substantially the same angle and being alignable in a common plane one with the other.

6. An apparatus, as set forth in claim 5, wherein the lagging edge of said inlet and leading edge of said angled entrance are of substantially the same angle and are alignable in a common plane one with the other.

7. An apparatus, as set forth in claim 6, wherein said fluid first member defines an outlet having angled leading and lagging edges similar to the respective lagging and leading edges of said inlet.

8. An apparatus, as set forth in claim 5, wherein said surface has a generally concave configuration with the concave portion facing in the direction of rotation of said pumping chamber.

9. An apparatus, as set forth in claim 5, wherein said vane is oriented with said lower edge extending in a direction parallel to the axis of rotation of said pumping chamber a lower edge portion directed generally in the direction of rotation of the pumping chamber.

10. In a fluid device having a first portion defining an inlet and a second portion defining at least one pumping chamber, said chamber being positioned in spaced relation to said inlet for receiving fluid therefrom and being rotatably movable relative to said inlet in a preselected direction at a preselected speed, the improvement comprising:

means, positioned in said pumping chamber adjacent the inlet, for contacting fluid at the inlet at a preselected angle sufficient for forcibly moving the fluid from the inlet and accelerating said fluid into said pumping chamber in response to rotation of said means with said chamber, said means comprising at least one vane having a surface and a lower edge and being positioned in the pumping chamber in spaced relation to said inlet.

11. An apparatus, as set forth in claim 7, wherein the surface is generally planar.

* * * * *